US005101759A

United States Patent [19]

Hefele

[11] Patent Number: 5,101,759

[45] Date of Patent: Apr. 7, 1992

[54] METHOD AND DEVICE FOR FORMING A GRID-LIKE COATING ON WEB-LIKE FLEXIBLE PLANAR MEMBERS AND PRODUCTS THEREOF

[75] Inventor: Josef Hefele, Gräfelfing, Fed. Rep. of Germany

[73] Assignee: Kufner Textilwerke GmbH, Munich, Fed. Rep. of Germany

[21] Appl. No.: 428,844

[22] Filed: Oct. 30, 1989

[30] Foreign Application Priority Data

Oct. 28, 1988 [EP] European Pat. Off. ..... 88117995

[51] Int. Cl.[5] ..... B05C 1/08

[52] U.S. Cl. ..... 118/202; 29/132; 118/212; 118/249; 118/258

[58] Field of Search ..... 118/202, 212, 249, 258; 29/132

[56] References Cited

U.S. PATENT DOCUMENTS

| | | | |
|---|---|---|---|
| 3,067,056 | 12/1962 | Remer | 118/212 |
| 3,086,879 | 4/1963 | Lassiter | 118/212 |
| 4,292,104 | 9/1981 | Heimbach et al. | 118/212 |
| 4,317,265 | 3/1982 | Chase et al. | 29/132 |
| 4,876,777 | 10/1989 | Chow | 29/132 |

FOREIGN PATENT DOCUMENTS 360365 4/1962 Sweden .

*Primary Examiner*—Michael Wityshyn
*Attorney, Agent, or Firm*—Scully, Scott, Murphy & Presser

[57] ABSTRACT

Method and device for forming grid-like coatings on web-like flexible planar structures and manufactured products thereof.

The invention relates to a method and device for forming grid-like coatings on web-like flexible planar structures with fusion adhesives in the powder gravure method by spreading fusion adhesive powder in the depressions of a rotating gravure roller (1) and transferring the gravure powder fillings onto the planar structure (8) with the use of a rotating heater roller (5) pressed onto the gravure roller. The invention is based on the object of so configuring a method and a device of this type that without additional expenditure they prevent the necessity for using additional web-like carrier strips for transferring the raster-like coating from the gravure roller onto the surface construction finally to be coated. For this purpose, the powder fillings in the depressions of the gravure roller are first transferred to the surface of the heater roller (5) pressed directly and forcibly onto this roller (1) and from here are transferred with use of a further rotating roller (9), pressed onto the heater roller with slight pressure, onto the planar structure guided between this and the heater roller.

10 Claims, 1 Drawing Sheet

METHOD AND DEVICE FOR FORMING A GRID-LIKE COATING ON WEB-LIKE FLEXIBLE PLANAR MEMBERS AND PRODUCTS THEREOF

Method and device for forming a grid-like coating on web-like flexible planar members and products thereof.

The present invention relates to a method and to a device for forming grid-like layers on web-like flexible planar members with fusion adhesives in the powder point gravure printing method and to manufactured products thereof.

Various methods are known for forming grid-like coatings, particularly dot screen coatings, on flexible planar structures such as weaves, textiles, woven textile goods, fleeces, foam materials, synthetic leather, foils etc. These methods operate either according to the screen printing method with pastes, or according to the gravure printing method with powders. In tis connection, these two basic modes of operation are combined with other coating methods, for example with spray coating or roll coating.

Other coating methods are also known in which the grid-like coating is first applied to a carrier and is then transferred from the carrier onto the actual planar structure to be coated. For example, from DE-B-2536911 a method is known for forming a powder coating as a grid-like netting on silicone carriers and transferring the coating onto batches of garments by ironing on the coated papers and peeling off the carrier. A dot screen-like coating on an adhesive repellent carrier paper is furthermore described by DE-A-2810042 and also such a dot-like coating is known from EP-A-219378 by application of a grid-like dispersion paste onto an anti-adhesive transfer carrier and transfer of the adhesive points onto web-like planar structures.

In many cases, these known transfer coatings exhibit advantages in that the coating points can be formed exactly and transferred onto surface constructions, which are not coatable or coatable only with difficulty in the direct coating method or exhibit in the direct coating process too great a tendency for the coating points to be retained by the coating carrier. Moreover, the previously known methods of operation are inconvenient when they are applied to the coating of web-like planar constructions such as for example web-like interlining materials.

Thus the transfer carrier according to EP-Al-0219378 must be adjusted exactly to the surface of the web to be coated and after the transfer process must be wound up and cleaned. Also seam locations in the transfer carrier always cause problems. If the carrier web is guided as an endless web in a loop, it is true that winding up is unnecessary. In spite of this it is however difficult to guide the web exactly and without distortion and to connect it to the connection position without shock. Also compression folds can occur.

The invention is therefore based on the object of providing a method and a device for forming grid-like coatings on web-like flexible planar structures with fusion adhesives using powder point gravure printing, which can be performed in a similar manner to the known coating methods without significant additional expenditure and prevents the necessity for using web-like carrier strips.

This object is achieved with a method and a device of the type initially described in which according to the invention fusion adhesive powder fillings spread into the depressions of a gravure roller are transferred first to the surface of a heated drum pressed directly and forcibly onto the gravure roller and from here with the use of a further rotating roller are pressed onto the heated roller with slight pressure and are transferred onto the planar structure passed between this and the heated roller.

The application pressure of this further roller via the planar structure onto the heated roller should thus be such that it is substantially smaller than the application pressure of the heated roller onto the gravure roller. Thus, for example, the heated roller can be pressed with a pressure of 1000 p/cm onto the gravure roller, whilst the further roller should be pressed via the planar structure onto the heated roller with a pressure of about 50 p/cm.

Expediently, the heated roller has an anti-adhesive rubber-like surface onto which the powder fillings of the gravure roller can be transferred by pressure. This surface can be formed by a roller coating which has a thickness of 1–10 mm and can consist of a soft completely vulcanised silicone rubber layer. In order to achieve good heat conduction through the layer, it can contain heat conductive fillers such as soot, metal powder, metal oxide powder or the like.

It is also expedient to provide the gravure roller with a thin baked separation film on the basis of tetrafluoroethylene, in order to promote the transfer of powder fillings onto the silicone rubber layer.

In order to cause completely reliable operation of the subsequent transfer process of the powder agglomerates, which have been released from the depressions of the gravure roller and sintered on the surface of the heating roller, onto the preferably web-like surface, it is expedient to use fusion adhesive powder which comprises a small proportion of about 0.1–2% fatty acids, for example palmitic acid, stearic acid or behenic acid finely dispersed.

The transfer process is to take place with slight application of pressure which is produced by the further rotating roller provided for the heated roller and between which and the heated roller the planar structure is reciprocated. During this transfer process, flattening of the powder agglomerates forming the coating takes place. Too great a flattening can be prevented by appropriate choice of a low application pressure of the roller.

The fusion adhesive masses suitable for the transfer process are the same as are applicable in the known method mentioned initially. Powders on the basis of copolyesters, copolyamides and polyethylenes and their mixtures are suitable. Also the particle sizes are the same.

The engraving and the coating can be configured in dot form, bar form or grid form.

The process conditions are practically the same as in the above mentioned known powder point gravure roller coating method, in which the gravure roller temperatures should lie in the temperature range of about 30°–90° C. and the heated roller temperatures in the temperature range of 1400°–240° C. according to the type of fusion adhesive employed.

With the method according to the invention and the device according to the invention a wide variety of surface structures can be coated, even those which as a result of a hairy or open mesh construction cannot be coated or can only be coated with difficulty in the direct coating method. Coated interlining materials on the basis of weaves, textiles, woven textile goods, fleeces, knitted fleeces, and woven knitted fleeces can be manufactured. Even coated synthetic leather, foils, papers, and foam materials can be produced without problems.

In the drawing, a particularly advantageous exemplary embodiment of the device according to the invention as well as a material web coated with this device are schematically illustrated, which will be described in more detail in the following:

Figure 1:
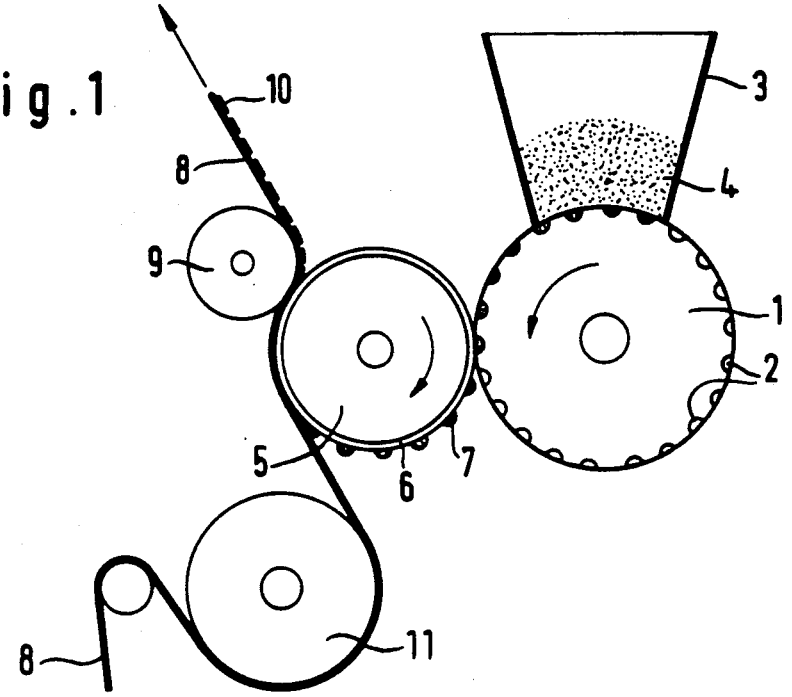
FIG. 1 shows this device in a schematic illustration partially in section and partially in side view.
Figure 2:
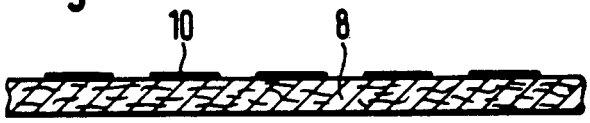
FIG. 2 is a longitudinal section through a surface construction coated with this device in an enlarged broken away representation.
Figure 3:
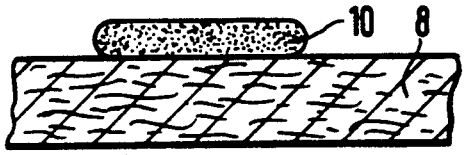
FIG. 3 shows a portion of FIG. 2 with even greater magnification.

The device illustrated in FIG. 1 comprises a funnel-shaped supply container 3 for powdery fusion adhesive 4 above the gravure roller 1, which is provided on its cylindrical surface with cup-shaped depressions 2 and is rotatable about its axis. This funnel is located directly on the gravure roller 1 and is open at its bottom so that the fusion adhesive powder 4 can flow out during movement of the surface of the gravure roller into the depressions 2 located therein. A doctor blade secured on the wall of the funnel and applied tangentially onto the gravure roller ensures smooth spreading of the powder introduced. The gravure roller is rotated in the direction of the arrow so that the depressions 2 filled with fusion adhesive powder are moved away to a heated roller 5 which is heatable and has an anti-adhesive rubber coating 6. This heater roller 5, which rotates in the direction of the arrow illustrated in FIG. 1 in conformity with the gravure roller 1, is pressed relatively strongly onto the gravure roller, whereby the powder fillings located in the depressions 2 of the gravure roller are transferred onto the rubber coating 6 of the heater roller and there remain as powder agglomerate 7.

The gravure roller 1 has on the surface, particularly of its depressions a thin separating film layer for easy removal of the powder fillings from these depressions, which can consist of material on the basis of tetrafluoroethylene.

On the side of the heater roller 5 lying opposite to the gravure roller the planar structure 8 to be coated is guided in the form of, for example, textile material web 8 across a pre-heating roller 11 and between the heating roller 5 and an associated further roller 9 which is so arranged that it presses the material web 8 only slightly against the heating roller 5. The heater roller and preheating roller are brought to a temperature of approximately 140° to about 240° C. which ensures that the powder agglomerates 7 resting on their surface 6 sinter together. As a result of the slight pressure of the material web 8 against the heating roller 5 and its previous winding with the material web, these sintered powder agglomerates are transferred to the material web, where they form a somewhat flattened grid-like coating. The grid-like coating can be punctiform, in bar form or in linear form. The arrangement and configuration of the coating grid 10 on the surface construction 8 is of course determined by the arrangement and configuration of the cup-shaped depressions 2 on the surface of the gravure roller. According to the desired type of coated grid on the planar structure, these depressions 2 on the surface of the gravure roller 1 must therefore be correspondingly arranged and configured.

I claim:

1. Coating apparatus for forming grid-like coatings on web-like flexible planar structures with fusion adhesives in the powder point gravure method, comprising: a rotatable gravure roller heated to about 30°-90° C. with a surface having depressions arranged in a grid form according to the desired coating; a rotatable heated roller heated to about 140° C.-240° C. and coated with an anti-adhesive rubber surface, arranged to be pressed onto said gravure roller resulting in a transfer of powder fillings from the gravure roller to the rubber surface; means for filling the depressions of the gravure roller with fusion adhesive powder; and a further rotatable roller arranged in relation to the heated roller in such manner that between the further rotatable roller and the heater roller the planar structure to be coated can be guided, the arrangement of the rollers being such that the application pressure of said further roller via the planar structure onto the heater roller is substantially smaller in operation than the pressure of application of the heater roller onto the gravure roller.

2. An apparatus according to claim 1 wherein the further roller presses the planar surface to be coated onto a peripheral portion of the heater roller the further roller being positioned so as to contact the heated roller at a point at least 180° C. from a point of contact between the heater roller and the gravure roller measured in a direction of rotation of the heater roller.

3. An apparatus according to claim 1 wherein the anti-adhesive rubber surface of the heater roller is formed from a rubber coating which has a thickness of 1-10 mm.

4. An apparatus according to claim 1 wherein said rubber surface on the heater roller is formed of silicone rubber.

5. An apparatus according to claim 1 wherein said rubber surface on the heater roller consists of soft rubber which is filled with heat conductive filler.

6. An apparatus according to claim 1 wherein the gravure roller has on the surface of its depressions a thin separating film layer for easy removal of the powder fillings from these depressions.

7. An apparatus according to claim 6 wherein the material of the separating film layer is based on tetrafluoroethylene.

8. An apparatus according to claim 1 wherein the depressions are arranged and configured in the surface of the gravure roller according to a desired grid-like coating having punctiform, linear form perpendicular to the longitudinal axis of the planar structure, linear form parallel to the longitudinal axis of the planar structure of grid form.

9. An apparatus according to claim 1 wherein the further roller maintains a temperature below about 100° C.

10. An apparatus according to claim 9 wherein the further roller is cooled by a cooling means to maintain a preferred temperature of below about 100° C.

* * * * *